US005182971A

United States Patent [19]

Williams

[11] Patent Number: 5,182,971

[45] Date of Patent: Feb. 2, 1993

[54] BUTTON SHARPENING

[75] Inventor: David S. Williams, Krugersdorp, South Africa

[73] Assignee: Boart International, Limited, Sandton, South Africa

[21] Appl. No.: 849,879

[22] Filed: Mar. 12, 1992

Related U.S. Application Data

[62] Division of Ser. No. 654,209, Feb. 12, 1991.

[30] Foreign Application Priority Data

Feb. 14, 1990 [ZA] South Africa ..... 90/1118
Aug. 21, 1990 [ZA] South Africa ..... 90/6616

[51] Int. Cl.[5] ..... B24B 7/10
[52] U.S. Cl. ..... 76/5.1; 76/108.2
[58] Field of Search ..... 76/108.2, 108.1, 108.4, 76/101.1, 5.1; 51/206 R, 288, 71, 72, 96, 97, 97 NC, 98 R

[56] References Cited

U.S. PATENT DOCUMENTS

| | | | |
|---|---|---|---|
| 2,268,599 | 1/1942 | Kinney et al. | 51/206 R |
| 3,830,020 | 8/1974 | Gomi | 51/206 R |
| 4,611,438 | 9/1986 | Siden | 51/206 R |
| 4,858,388 | 8/1989 | Bice | 51/73 R |
| 4,977,709 | 12/1990 | Siden | 51/206 R |

FOREIGN PATENT DOCUMENTS

| | | |
|---|---|---|
| 90/3988 | 5/1990 | South Africa . |
| 1229833 | 4/1971 | United Kingdom . |
| 2193456 | 2/1988 | United Kingdom . |

*Primary Examiner*—Roscoe V. Parker
*Attorney, Agent, or Firm*—Fish & Richardson

[57] ABSTRACT

A hardmetal drill bit button is restored by forming its head to a chisel shape. Various chisel shapes and a machine for the purpose are disclosed. Also disclosed are various kinds of grinding wheels for the purpose, and a method and means for simultaneously dressing the steel of the bit body.

8 Claims, 4 Drawing Sheets

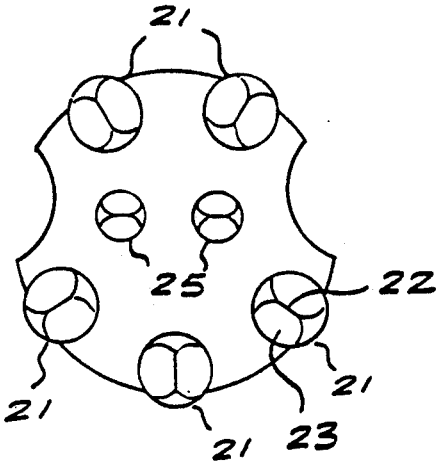
FIG 3
FIG 4
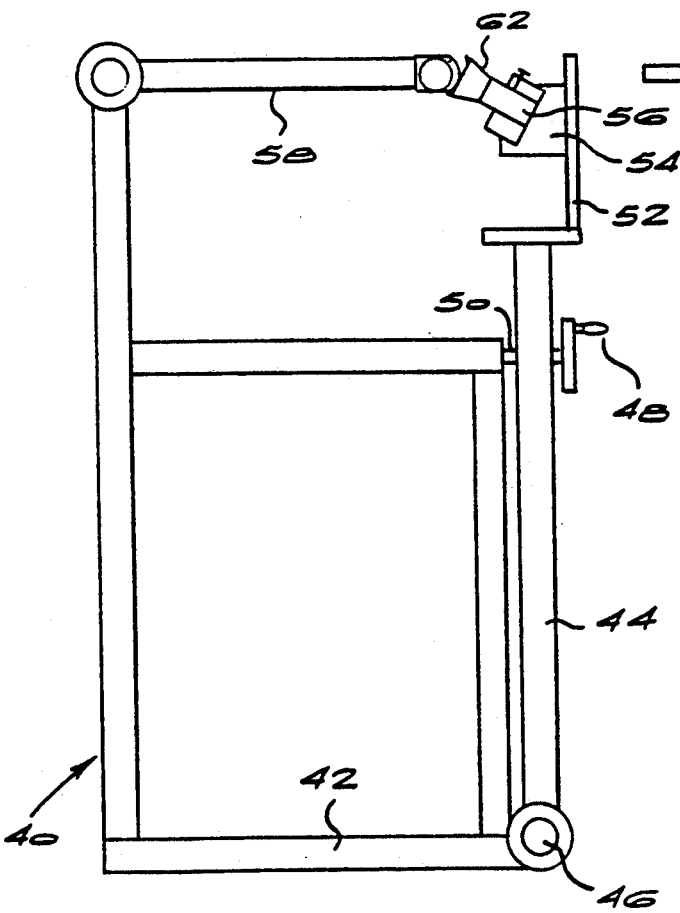
FIG 5
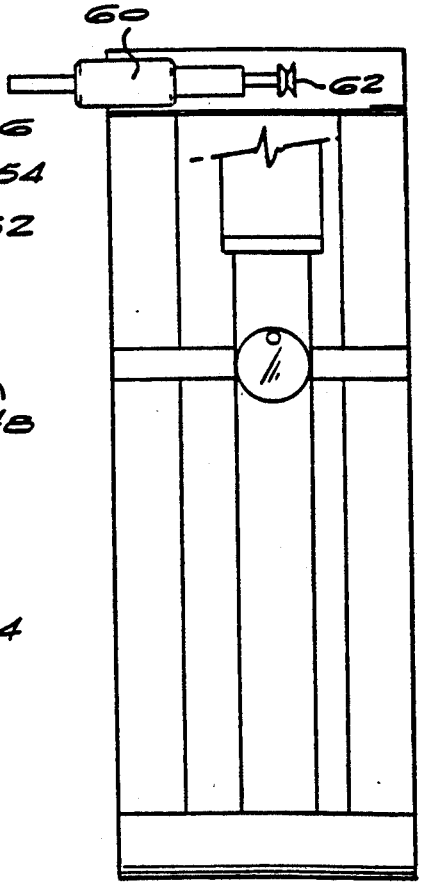

FIG 6
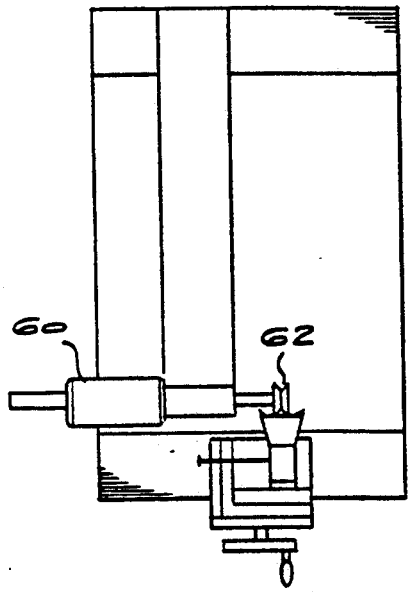
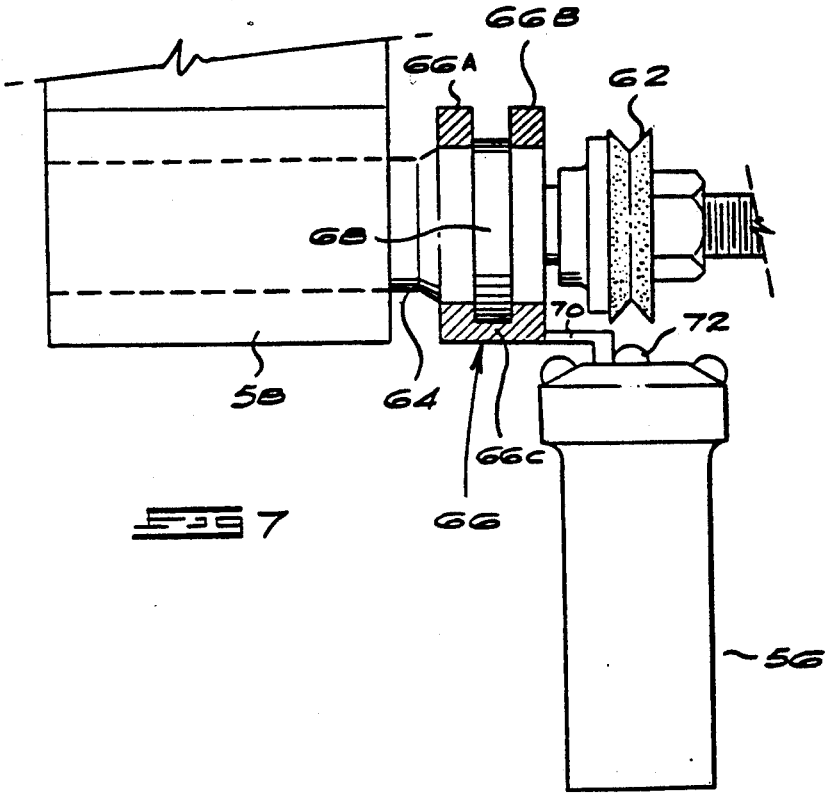
FIG 7

BUTTON SHARPENING

This is a division of application Ser. No. 07/654,209, filed Feb. 12, 1991.

BACKGROUND TO THE INVENTION

This invention relates to the sharpening of hardmetal buttons on button-type drill bits.

Conventional button sharpeners are designed to restore the initial hemispherical shape of the button heads. They remove too much hardmetal and this could result in a lower bit life by reducing the amount of hardmetal protecting the gauge. Many worn out button bits are discarded when the gauge falls below a certain diameter.

SUMMARY OF THE INVENTION

A first aspect of the invention provides a method of restoring a worn drill bit button wherein the worn button is restored by forming its head to a chisel shape.

The angle included by the chisel shape is preferably in the range 90° to 130° and is most preferably about 110°.

A gauge button on a drill bit may be restored by forming its head to a chisel shape with the apex of the chisel shape running radially.

Steel may be removed from the steel body of a drill bit in which the button is set at the same time as the button is restored.

Conveniently, the button is restored by means of a grinding wheel formed with a V-groove at its periphery designed to produce the desired chisel shape in the head of the button. In one version, the button is restored by forming its head to a chisel shape having a sharp apex using a grinding wheel having a V-groove with a sharp bottom. In another version, the button is restored by forming its head to a chisel shape having a rounded apex using a grinding wheel having a V-groove with a rounded bottom. In yet another version, the button is restored by forming its head to a blunt chisel shape using a grinding wheel having a V-groove with a flat bottom.

The grinding wheel may be used to restore the button and simultaneously to remove steel from a bit body in which the button is set.

A second aspect of the invention provides a machine for restoring a button bit comprising a grinding wheel with a V-groove at its periphery, means for locating a button bit relative to the grinding wheel with a button which is to be restored in alignment with the periphery of the wheel, and means for causing relative movement to take place between the button bit and the wheel such that the button is fed into the V-groove with the result that the head of the button is formed to a chisel shape.

The machine may have a bit holder provided at the end of a bit arm for holding the button bit, the bit arm being pivotable to move the button bit arcuately relative to the grinding wheel to feed the relevant button into the V-groove at the periphery of the grinding wheel.

A third aspect of the invention provides a method of restoring a drill bit having a steel body in which buttons are set, wherein each button is restored by grinding its head to a chisel shape while at the same time steel is removed from the vicinity of the button.

A fourth aspect of the invention provides a grinding wheel for restoring a hardmetal drill bit button, the grinding wheel having a V-groove at its periphery that is adapted to produce a chisel shape in the head of a hardmetal button fed into the groove.

BRIEF DESCRIPTION OF THE DRAWINGS

The invention will now be described in more detail, by way of example only, with reference to the accompanying drawings in which:

FIG. 3 shows a face view of a drill bit with buttons resharpened according to the invention;

FIG. 4 shows a side view of a resharpening machine;

FIG. 5 shows an end view of the machine seen in FIG. 4;

FIG. 6 shows a plan view of the machine seen in FIGS. 4 and 5;

FIG. 7 shows a detail of a portion of the machine seen in FIGS. 4 to 6 at an enlarged scale;

SPECIFIC DESCRIPTION

Figure 1:
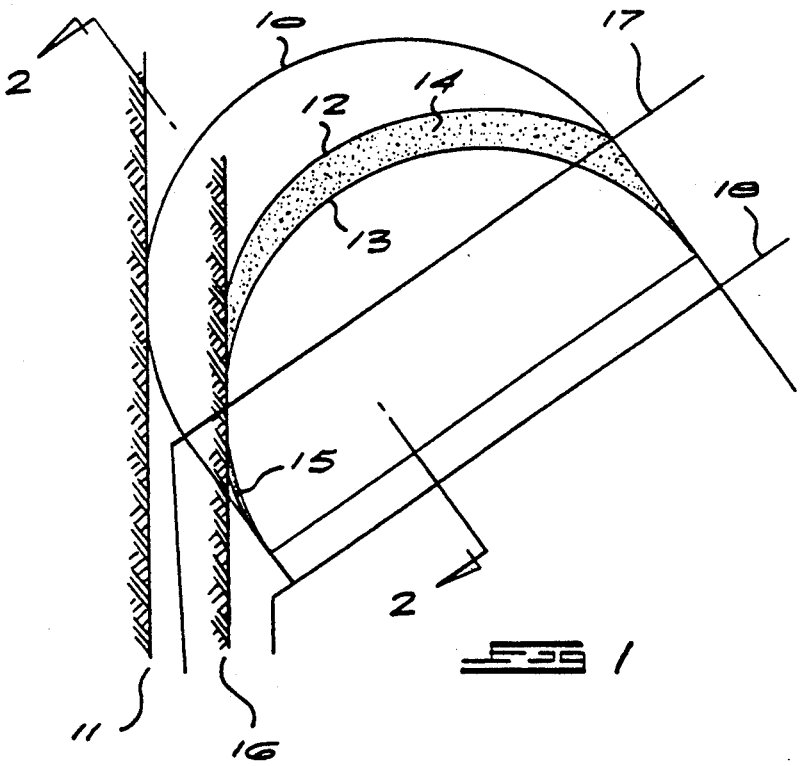
FIG. 1 illustrates the wear on a gauge button.
Figure 2:
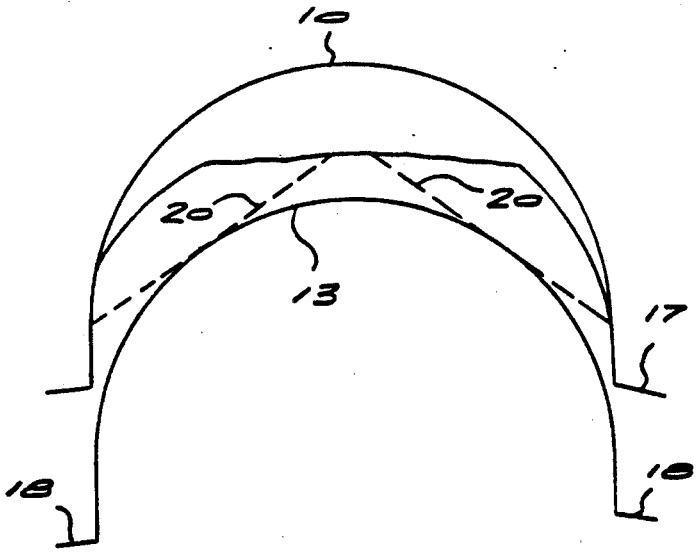
FIG. 2 shows a cross-section at the line 2—2 in FIG. 1 and illustrates the chisel shape of the invention superimposed on as new, worn and conventionally sharpened profiles.

The gauge button shown in FIGS. 1 and 2 had an as new profile indicated by the curve 10, with a gauge line 11. The actual worn profile that such a bit would take on is indicated by the line 12, giving a worn gauge line 16, and conventional resharpening would result in a fresh surface marked 13. In zones 14 and 15 hardmetal has, in the opinion of the inventor, been removed unnecessarily. The surface of the as new steel body is indicated by the numeral 17 and the surface, after deplating, shotblasting, grinding or any combination of these metal removal techniques, is indicated by the numeral 18.

With the resharpening method proposed by the present invention the lines 20 would represent the top of the button in FIG. 2. This saves a considerable amount of hardmetal and does not reduce the as worn gauge.

A resultant bit is shown in FIG. 3. On the gauge buttons 21 flat faces 23 are formed to the sides of radial chisel apices 22. On the face buttons 25 the chisel apices are in line for ease of forming the wedge shaped surface.

FIGS. 4 to 7 illustrate a machine which is used to sharpen buttons in the manner proposed by the invention. The machine has a frame 40 with a base 42 to which a bit arm 44 is pivoted at a horizontal axis 46. A rotary handle 48 acting on a screw threaded rod 50 acts to swing the bit arm in the clockwise or anticlockwise direction as viewed in FIG. 4. A bracket 52 and adjustable bit holder 54 are connected to the upper end of the bit arm as illustrated, with the bit holder 54 being used to hold a button bit 56 of which the buttons are to be sharpened.

A wheel arm 58 is pivoted to the upper end of the frame 40 and carries a rotary grinder 60 towards its free end and a diamond wheel 62 at its extreme free end.

Referring to FIG. 7, the rotary spindle 64 of the grinder 60 carries a rotatable ring 66 having two sections 66A and 66B between which a fixed ring 68 is carried by the spindle. The sections 66A and 66B are connected to one another by a base section 66C from which an L-shaped abutment 70 projects. The ring 68 is fixed to the spindle 64 at a predetermined axial distance from the diamond wheel 62.

In operation, with a button bit held in the bit holder 54, the abutment 70 is rotated to a position in which it is opposite the button 72 which is to be refurbished. The bit is rotated on the bit holder 54 to bring the button 72 against the abutment 70, and the bit is then locked to the bit holder in this position. The rotatable ring 66 is then rotated on the grinder spindle to move the abutment 70 out of the way of the diamond wheel 62. The bit holder 54 is adjustable to allow sharpening of any button in a bit regardless of its angle of insertion relative to the bit axis.

It will be appreciated that the function of the rings 66 and 68 and the abutment 70 is to bring the centre of the button which is to be ground to the correct position relative to the central plane of the diamond wheel 62.

Next, the handle 48 is rotated to feed the button 72 into the diamond wheel 62 which performs the desired sharpening action on it. As the button is fed into the wheel, the wheel arm 58 is moved up and down about its pivot. Once the operator has brought the button 72 to the desired degree of sharpness, he retracts the button. Alternatively, to ensure that over-sharpening does not take place, a mechanical stop can be incorporated to limit the extent to which the bit arm can be swung, and therefore the distance through which the button 72 can be moved against the diamond wheel.

As an alternative to the use of a machine as described above, in which the button is fed into the wheel to achieve the desired grinding of the button, it is also possible to clamp the bit firmly in an appropriate clamp and then to move an appropriately shaped, rotating grinding wheel manually against the chosen button.

Figure 8:
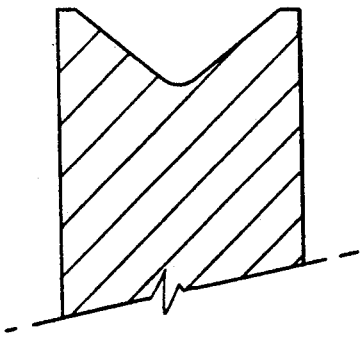
FIG. 8 shows an alternative wheel profile.

The wheel 62 as described in the above example has a profile designed to produce on the button a chisel shape with a sharp apex. A very sharp apex may be undesirable, particularly for the gauge buttons. FIG. 8 shows a slightly different wheel profile which has a somewhat more rounded bottom to the V-groove to produce a chisel shape on the sharpened button which has a more rounded apex.

Figure 9:
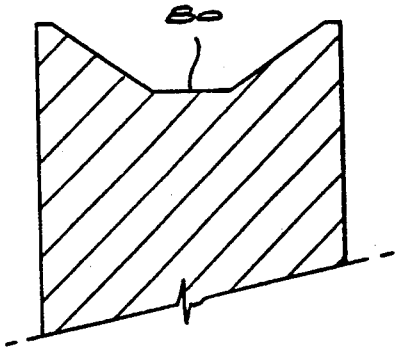
FIG. 9 shows yet another wheel profile.

For gauge buttons a wheel profile such as that illustrated in FIG. 9 is preferred. In this case, the bottom of the V-groove in the wheel is formed with a flat 80 to produce sharpened gauge buttons which have blunt chisel shapes.

In all cases, the angle included by the convergent faces on a sharpened button is around 110°.

Reference was made above to the deplating of the steel body of the drill bit to relieve it to a shape suited to the new shapes of the buttons. Deplating, or alternatively shotblasting, to provide the steel body with the desired new shape are however inconvenient operations which require bulky pieces of equipment that are difficult to transport. This detracts from the simplicity of the technique of refurbishing the buttons by the chisel-sharpening method described above. Whereas chisel sharpening could be achieved on site, steel removal by deplating or shotblasting normally could not.

Figure 10:
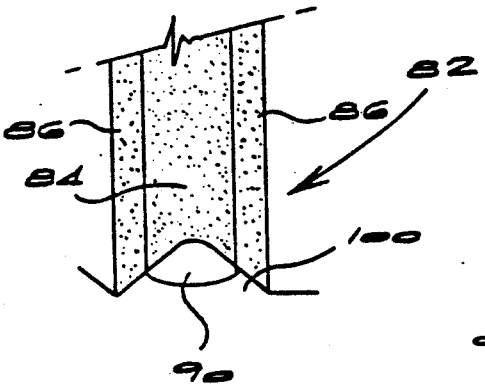
FIG. 10 illustrates the grinding of a button by a modified wheel, looking in the direction of the arrow 10 in FIG. 12.

With a view to overcoming the problem presented by steel removal, the wheel 82 seen in FIG. 10 is somewhat wider than the wheels described previously and has an inner section 84 sandwiched between outer sections 86. The inner section 84 is composed of material suitable for grinding the hardmetal buttons themselves, while the outer sections 86 are composed of material suitable for grinding steel.

In use the wheel 82 of FIG. 10 performs a chisel-sharpening exercise on a button, but also acts on the steel 100 alongside the button as illustrated in FIG. 10, thereby removing the surplus steel and, hopefully, obviating the need for an extra steel removal step using deplating or shotblasting.

Figure 11:
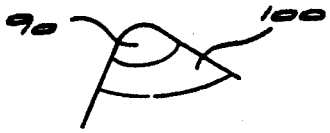
FIG. 11 illustrates a refurbished gauge button, looking in the direction of the arrow 11 in FIG. 12.
Figure 12:
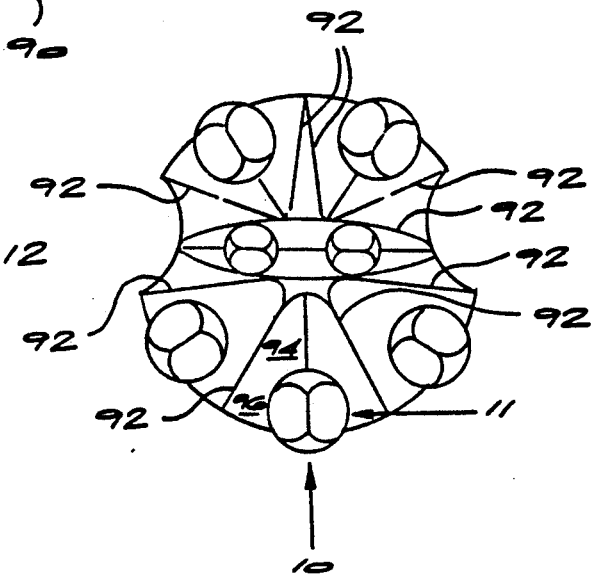
FIG. 12 shows a face view of a button bit of which the buttons have been refurbished with the wheel seen in FIG. 10.

FIG. 11 illustrates the sharpening action applied to a gauge button 90 and the steel 100 in its vicinity, looking in the direction of the arrow 11 in FIG. 12. The lines 92 in FIG. 12 indicate the anticipated shape of the steel body at the bit face after the simultaneous button sharpening and steel grinding exercise.

Bearing in mind that relative movement between the grinding wheel and the bit only take place, for each button, in the direction in which the final button apex extends, it will be appreciated that steel in regions such as that numbered 94 in FIG. 12 will not be removed to the same extent as in regions such as that numbered 96 that lie immediately to the sides of the buttons.

In the end result, the gauge buttons are associated with radially inwardly directed "comet tails" of steel. It is not anticipated that this will be unduly detrimental to the successful operation of the bit during subsequent drilling operations.

Initial testwork conducted by the inventor indicates that sharpening the drill bit buttons in the manner proposed by the invention can lead to an increase in the depth of a hole which it is possible to drill before the bit becomes unserviceable, in the penetration rate of the bit and to a decrease in refurbishment time when compared to the conventional button refurbishment technique. The test results are tabulated below for three tests conducted respectively at Randfontein Estates gold mine in the Republic of South Africa, at Denison Mine in Canada and at Laisvall Mine in Sweden.

TABLE

| TEST NUMBER | 1 | 2 | 3 |
|---|---|---|---|
| % Increase in meters drilled | 16 | 12 | 35 |
| % Decrease in gauge loss | 40 | — | 43 |
| % Increase in penetration rate | 0 | 0 | 10 |
| % Decrease in refurbishment time | — | — | 61 |

I claim:

1. A machine for restoring the buttons of a button bit, the machine comprising a grinding wheel with a V-groove at its periphery, means for locating and non-rotatably holding a button bit relative to the grinding wheel with a button which is to be restored in alignment with the periphery of the wheel, and means for causing relative movement to take place in one plane only between the button bit and the wheel such that the button is fed into the V-groove with the result that the head of the button is formed to a chisel shape.

2. A machine according to claim 1 comprising a bit holder provided at the end of a bit arm for holding the button bit in a non-rotatable manner, the bit arm being pivotable to move the button bit arcuately relative to the grinding wheel in the said one plane and without rotation of the button, to feed the relevant button into the V-groove at the periphery of the grinding wheel.

3. A machine according to claim 1 wherein said V-groove of said grinding wheel has a shape to grind the button head to a chisel shape having an included angle in the range 90° to 130°.

4. A machine according to claim 3 wherein said included angle is about 110°.

5. A machine according to claim 3 wherein said V-groove has a sharp bottom, thereby to produce in the button head a chisel shape having a sharp apex.

6. A machine according to claim 3 wherein said V-groove has a rounded bottom, thereby to produce in the button head a chisel shape having a rounded apex.

7. A machine according to claim 3 wherein said V-groove has a bottom having a flat surface, thereby to produce in the button head a blunt chisel shape.

8. A machine according to claim 3 wherein said grinding wheel comprises a central section adapted to produce a chisel shape in the head of the button and outer sections between which said central section is located, said outer sections being adapted to remove material from the body of the drill bit at the same time as the chisel shape is produced in the head of the button.

* * * * *

UNITED STATES PATENT AND TRADEMARK OFFICE

CERTIFICATE OF CORRECTION

PATENT NO. : 5,182,971

DATED : February 2, 1993

INVENTOR(S) : David S. Williams

It is certified that error appears in the above-indentified patent and that said Letters Patent is hereby corrected as shown below:

On the title page, Item [56] Foreign Patent Documents: add the following:

| | | |
|---|---|---|
| 2 193 456 | 02/10/88 | Great Britain |
| 1 229 833 | 04/28/71 | Great Britain |
| 90/3988 | 05/23/90 | South Africa |

On the title page, under Other Documents, please add the following:

"Sandvik Coromant Rock Drilling Tools Guide Bit"; Atlas Copco Catalogue (11397)

Signed and Sealed this

First Day of March, 1994

Bruce Lehman

*Attest:*

BRUCE LEHMAN

*Attesting Officer*

*Commissioner of Patents and Trademarks*